US005513774A

United States Patent [19]

Dominquez

[11] Patent Number: 5,513,774

[45] Date of Patent: May 7, 1996

[54] PILL OR TABLET DISPENSER

[75] Inventor: Manuel A. M. Dominquez, Fracc/Los Robles, Mexico

[73] Assignee: Leiras International, S.A., Benito Juarez, Mexico

[21] Appl. No.: 286,886

[22] Filed: Aug. 5, 1994

[51] Int. Cl.[6] ..... B65H 1/08

[52] U.S. Cl. ..... 221/232; 221/268

[58] Field of Search ..... 221/268, 270, 221/272, 191, 167, 171, 232, 233

[56] References Cited

U.S. PATENT DOCUMENTS

| | | | |
|---|---|---|---|
| 2,731,268 | 1/1956 | Raizen | 221/167 |
| 3,313,452 | 4/1967 | Katz | 221/268 |

OTHER PUBLICATIONS

Abstract from Mexican Patent Application No. 92 01153 published in Oct. 1992, to Manual A. Martinez Dominguez.

*Primary Examiner*—Kenneth Noland

*Attorney, Agent, or Firm*—Gottlieb, Rackman & Reisman

[57] ABSTRACT

An improved pill or tablet dispenser, the design of which has several outstanding features including, in the first place, setting free exclusively a single pill or tablet at a time during the actual use of the dispenser, with the advantage that said released pill or tablet will exit entirely intact, and in the second place, if for any reason the user of the dispenser does not require the released pill or tablet, the latter can be returned to the inside of the dispenser without being touched by the fingers, and therefore the user does not need to receive a large number of pills or tablets in his hand, only to later deposit most of them back into the dispensing device. Rather, they will exit directly from the dispenser, and therefore, a much more hygienic operation is logically performed.

1 Claim, 2 Drawing Sheets

PILL OR TABLET DISPENSER

BACKGROUND OF THE INVENTION

This invention relates to the pharmaceutical and domestic industries, and refers specifically to an improved pill or tablet dispenser.

DESCRIPTION OF THE PRIOR ART

The existence of pill or tablet dispensers in the market is not entirely new, as different, ingenious forms or presentations of these dispensers have been known for a long time. Among them, we can mention, for example, the most common dispenser consisting of two parts, the first being a cap which has in the inside a series of channels with two side slots, and the second a base with two projections which are prolonged upward on the upper end, which are coupled inside the side slots of the cap and slide between the channels forward or backward, thus showing an opposite opening in each case, and in both cases, upon tilting the device, allowing the immediate exit of almost all the pills placed inside the base. This device has the disadvantage that when used, a plurality of the contents is quickly released, as it is impossible to control the exit of the product; furthermore, this dispenser has the inconvenience of being rather bulky.

In another presentation of the prior art, there is a rounded, rectangular container formed by two pieces, one of which forms the container itself, which in turn consists of two lids, an upper and a lower one, wherein the upper one in addition to having a peripheral flange, has a circular orifice on one side, and in the middle part, an elongated rectangular opening through which a sliding piece is introduced. The sliding piece has a projection on the lower part which connects under pressure by the rectangular opening, and moves through it forward or backward by the finger of the user, closing or opening the circular orifice, thus causing the product from inside the container to exit or not through the orifice when the container is abruptly turned upside down. However, if this motion is made carefully, tilting the container almost horizontally, the product can exit one by one. The main defect of this device is that if it is not carefully handled, a plurality of tablets exit indiscriminately from the inside, and therefore they have to be put back in by hand, something which for hygienic reasons is not a commendable operation.

In another of the simplest embodiments known in the market, there is a small, flat, rectangular container formed by two molded plastic pieces. The lower plastic piece serves as a receptacle, and includes a peripherally arranged short flange, slightly toward the outside, with a dividing zone inside with an arched projection on one side, which serves as a guide for the pills, and which widens progressively toward one of the corners to cause the exit of the product. The upper plastic piece serves as a lid with an almost totally internal edge, interrupted only on one side of its ends, and which has a series of notches inside which connect with the container flange and which allow it to slide in on only one end, thus allowing the exit of one or several pills during each use of the device. The defect of this dispensing device is that it constantly breaks the product, with part of the product remaining inside, and therefore the entire product is not used; for this reason its use is neither convenient nor commendable.

Another of the dispensers known in the prior art is that formed of an elongated, bulky container with slightly arched shapes with a sufficient extension to be secured inside the hand. This device consists of three pieces, one of which serves as a container or support, and which has a hollow lower part through which the product will exit from the inside; it also has a cavity inside which narrows downward and which limits the exit of the product; and lastly, in its lower part it has a small horizontal, rectangular channel. The second piece is an upper lid through which the contents of the dispenser are filled or emptied, and the third piece is a slightly arched side piece which acts as a trigger or activating lever, and which is a shaft structure with projections prolonged forward that are used as a support and a perforated, perpendicular tongue through which fits only one of the pills from the inside, and which has a projection at the end to fix it adequately and avoid its coming off. Although this device produces the individual exit of the tablets, its main defect is that it frequently breaks the pills when used, and as its closure is inadequate, loose portions of the broken product continuously exit through the interstices of the container, producing an undesirable effect.

Although it is true that because of the length of the time since the appearance and use of these devices, they have been built in different sizes and designs, in which a plurality of materials has been used which have generally been efficient, it is nevertheless also true that each of them has inconveniences arising mainly from their use. Consequently, and in order to try to solve the above-mentioned problems, we visualized the need to create a more versatile, practical, efficient dispenser with a simpler construction, which of course, does not have so many inconveniences as the devices presently available in the market.

OBJECTS OF THE INVENTION

One of the main objects of this invention is to provide a novel tablet, pastille or pill dispenser which is quite different from those known, and which functions efficiently, effectively releasing one tablet at a time.

Another of the objects of this invention is that upon use of the dispenser, the tablets, pastilles or pills are not broken or mistreated either before or after their release.

Still another of the objects of this invention is to be able to return the product to the inside without the use of the fingers, if the product is not required for any reason.

Another of the objects of this invention is to provide a dispenser which because of its harmonious industrial design and the type of materials from which it is made, guarantees that it does not open or break during accidental falls.

BRIEF DESCRIPTION OF THE DRAWINGS

The detailed features of this improved tablet dispensing container are clearly shown in the following description, and in the drawings which are enclosed as a more precise means of illustrating my invention, in which the reference numerals will indicate the same parts in the indicated figures, and wherein.

DETAILED DESCRIPTION OF THE INVENTION

Figure 1:
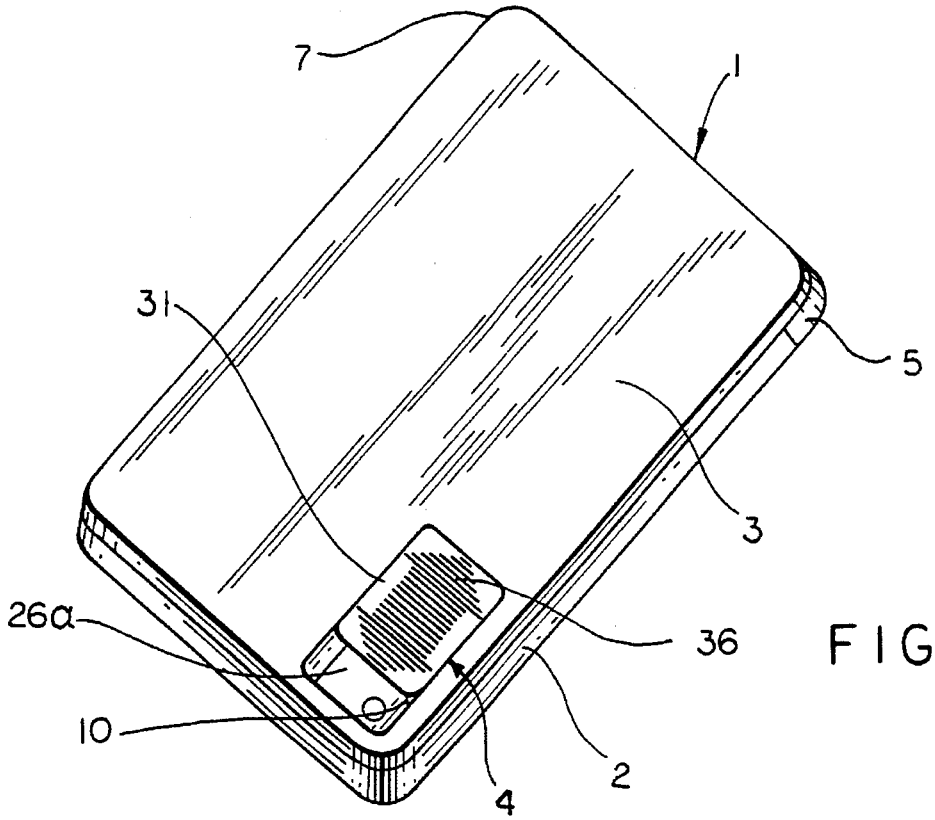
FIG. 1 is a perspective view of the front of the tablet dispensing container I have invented, showing its parts in their assembled condition, and with an open orifice for allowing just one of the tablets to exit.
Figure 2:
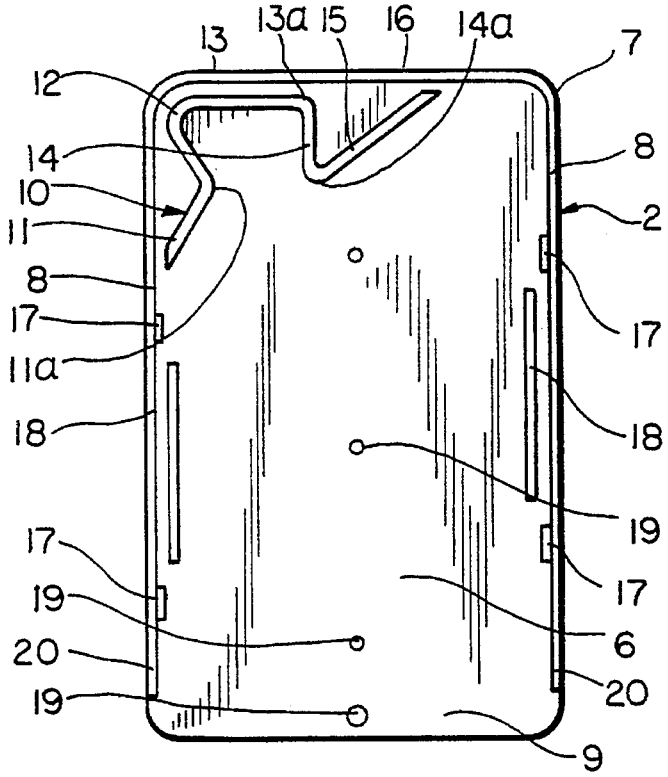
FIG. 2 is a frontal view of the inside of the lower part of the container shown in FIG. 1 in which we see a series of internal projections needed for proper operation.

In a preferred embodiment, but in no way limiting, and in agreement with the drawings shown previously, the improved tablet dispensing container I have invented has the generic form of a small, flat, rectangular container 1 comprising a series of molded sections which when coupled, function as a single piece. The container 1 is most preferably formed by two pieces of greater dimensions but with similar external measurements, which couple one over the other and form the container itself, in which one of them acts as a receptacle 2 of the tablets to be released, and the other functions as a lid or cover 3 of the receptacle 2, plus two pieces with lesser dimensions, one of which serves as a slidable door or gate 4 and the other of which serves as a terminal lid or cap 5.

The piece which functions as a receptacle 2 has a flat, rectangular base 6 with rounded corners 7, abutted with a flange 8 of a considerable height which extends almost completely around the periphery of the flat base 6, but which is interrupted almost upon reaching the beginnings of one pair of the rounded corners 7, thus forming a smooth end 9 of the flat base 6. At one of the corners opposite the smooth end 9 there is a separating means 10, preferably in the form of a stylized twisting protuberance which at one end is spaced slightly away from one of the lateral edges of the base 6 and which has a first accurate portion 11 with an apex **11*a* oriented toward the inside of the receptacle 2, a first perpendicular curved portion 12 that is curved inward, a first straight portion 13 running parallel to the edge of the receptacle 2, a second curved portion 13*a*, a second straight portion 14 running toward the inside until reaching a point opposite the apex 11*a*, a second arcuate portion 14*a*, and a third straight portion 15 sloping toward the edge but without touching it, leaving a small space 16** between the edge and the other end of the protuberance.

The receptacle 2 also has on both side edges a pair of small short projections 17, spaced a convenient distance apart, the height of which is almost half of the height of the flange 8. Between the adjacent pairs of projections 17, but placed on the flat base 6, are a pair of straight, super-elevated segments 18, each of which is spaced apart from, but runs parallel to, the adjacent edge of the surface of the flat base 6. There are also three perforated posts 19 at a distance from each other, but vertically aligned along the mid-point of the flat base 6. Lastly, on both terminal ends of the flange 8, there is a groove 20 arranged vertically in relation to the flange 8.

Figure 3:
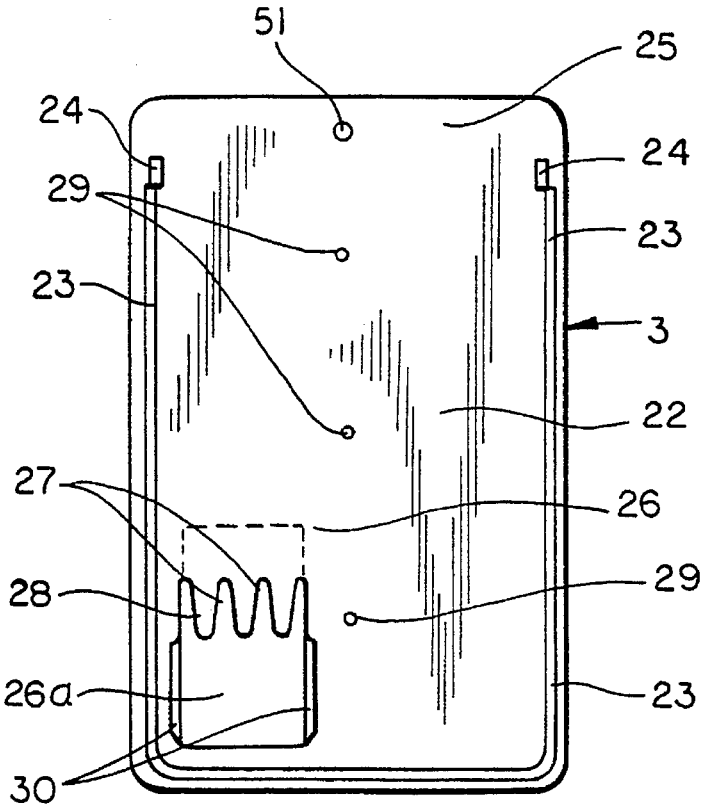
FIG. 3 is a plan view of the back part of the lid of the container of FIG. 1, in which we see a recess with an opening at one of the corners.
Figure 4:
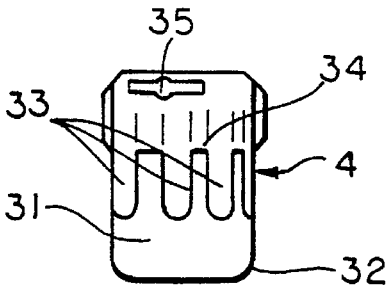
FIG. 4 is a plan view of the inner part of a gate which connects inside the recess of the lid of the tablet container shown in FIG. 3.
Figure 5:
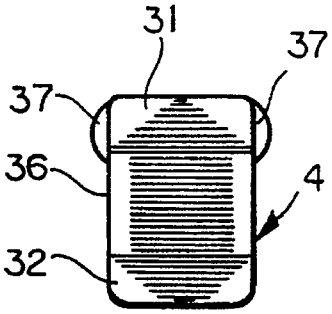
FIG. 5 is a plan view of the outer part of the gate shown in FIG. 4.
Figure 6:
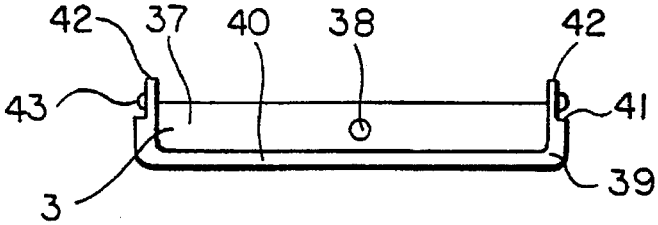
FIG. 6 is an upper view of the terminal cap which closes the opening through which the contents or product of the container is initially inserted.

The cover 3, as mentioned previously, has the same external measurements as the receptacle 2 and comprises a base 22 which has a continuous border 23 separate from its edges. The border 23 is interrupted almost upon reaching one of the ends of the cover 3, and is limited by two butts 24, thus leaving exposed a smooth part 25 of the base 22. On its opposite surface (not shown), at one of the corners opposite the smooth part 25, the base 22 has a recess 26 that is preferably rectangular (part of which is shown in phantom lines in FIG. 3). A portion of the cavity 26 is cut away to form an opening **26*a* with a series of interstices 27, thus forming some projections 28 in the form of fingers which extend horizontally. The cover 3 also has in the central portion of the smooth part 25, a circular projection 25' which is not very high. In the central part of the base 22 there is also a series of small projections 29 in symmetrical alignment with the posts 19 of the receptacle 2 where they penetrate. In addition, the opening 26*a* has some small elongated recesses 30 on both edges which do not reach the zone of interstices 27**.

The continuous border 23 of the base 22 of the cover 3 has a series of slots (not shown) on the walls at the midway point of the height of the border 23, strategically distributed so that they couple with the short projections 17 when the two pieces are assembled.

Both the receptacle 2 and the cover 3 couple over each other by means of the flange 8 and the border 23, the segments 18 adjusting to each other, thus forming a container which is open at the smooth end 9 of the receptacle 2 and at the smooth part 25 of the cover 3; before they are finally assembled, however, care must be taken to introduce into the recess 26 a piece with the form of a slidable gate 4 which fits precisely within recess 26 and over opening **26*a***.

The gate 4 is a small flat piece which has a rectangular base 31 on the inner part with rounded corners 32. On one of its ends, the base 31 has a series of projections in the form of fingers 33 which horizontally protrude to the half-way point of the piece, limited by a butt 34. Also, abutting the base 31, and located on one of its corners, there is a projection 35 with a considerable height. The fingers 33 of the track 4 penetrate and join inside the projections 28 of the opening **26*a* of the cover 3**.

On the outer part, the gate 4 preferably has a series of horizontal grooves 36 over almost the entire surface, and at one of its ends there are two curved projections 37, one on each side of the gate 4, the function of which is to be slidably supported inside the elongated recesses 30 of the opening **26*a* of the cover 3, while the grooves 36 will serve to facilitate the movement of the gate 4** forward or backward.

The last section of my container consists of a terminal cap 5 which comprises a rectangular piece 37 with a length equal to the widths of the cover 3 and of the receptacle 2, and which in the central part has a circular perforation 38. The cap 5 also has rounded corners 39, and has all along its periphery an edge 40 with a relative height, limited at the end of the rounded corners 39 by two vertical cuts 41 forming two projections 42 which have a small border 43 arranged vertically. The cap 5 completely closes the space between the smooth end 9 of the receptacle 2 and the smooth part 25 of the cover 3, with the central perforation 38 being fastened inside the circular projection 25', and with the borders 43 also being secured, which borders penetrate inside the grooves 20 of the flange 8 of the receptacle 2. The container 1 which is thereby formed at no time can be crushed due to the action of the perforated posts 19 of the receptacle 2 and of the projections 29 of the cover 3 which penetrate into them.

The operation of my dispensing container, once it has been filled with tablets and has been closed, being then completely assembled, is completely mechanical and operates basically by the forward or backward displacement of the gate 4, which is provided on the lower part with a projection 35 that, because of its height, operates as a straight edge which, upon backward displacement of gate 4, allows the tablets to flow. To operate the container, it must be held tilted at approximately 30 degrees, with the gate toward the user, and then the gate must be displaced backward so as to open the orifice where a single tablet will be found, which will fall by itself into the desired place, and lastly, the gate must be slid forward to close the orifice, and if another tablet is desired, the indicated operation may be repeated.

Even though the invention has been shown and described in relation to a single specific embodiment, it will be understood by those skilled in the art that changes may be made in it which will be included within the spirit and scope of the invention, as indicated in the appended claims.

I claim:

1. A dispensing container for tablets or pills comprising a small flat, rectangular box constituted by a series of parts which when assembled function as a single integrated unit, said container being formed by two pieces of greater dimensions but having similar external measurements which couple one over the other, wherein one acts as a holder and the other as a cover, and two pieces of lesser dimensions which serve, one as a gate and the other as a terminal cap for filling, emptying or stopping the container, wherein:

(a) the holder comprises (1) a flat base having a smooth end and several straight segments and a series of posts vertically aligned, said base being limited substantially on three sides by a peripheral flange with vertical projections and slots conveniently distributed thereabout, and (2) a separating means in the form of a twisting super-elevation which is located separate from the edges of the base, (b) the cover has (1) a smooth part, (2) a continuous border separate from its edges which is interrupted at one edge of the cover at the smooth part where there is a circular projection, and (3) a recess which is located at the opposite edge of said cover at one of its corners, the floor of which is partially cut away to form some finger-like projections and to form an opening in said cover, said opening having a pair of opposing lateral grooves, (c) said gate comprises (1) a flat piece with finger-like embossments at one end and a curved projection on either side thereof, both of said curved projections being engageable with the opposing lateral grooves of said opening whereby the gate is slideably disposed within said opening for reciprocation of the gate between an open position and a closed position to selectively close said opening, said finger-like embossments being engageable with said finger-like projections in said recess to selectively retain said gate in said open position, and (2) a straight edge of little height disposed on the inner portion of the gate, and (d) said terminal cap comprises two ends and a central perforation, wherein upon assembly of the container the central perforation couples with the circular projection of the cover, and the ends of the terminal cap are adjusted in the space formed by the smooth end of the base of the holder and the smooth part of the cover by means of the engagement of the border of said cover with the flange, posts and slots of said holder.

* * * * *